US010602909B2

(12) United States Patent
Gupta et al.

(10) Patent No.: US 10,602,909 B2
(45) Date of Patent: Mar. 31, 2020

(54) STABLE HEIGHT ADJUSTER MECHANISM

(71) Applicant: Whirlpool Corporation, Benton Harbor, MI (US)

(72) Inventors: Kapil Gupta, Pune (IN); Richard Lawrence Kretz, Findlay, OH (US); Ronald M. Nowell, St. Joseph, MI (US); Matthew M. Hansen, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 89 days.

(21) Appl. No.: 15/908,969

(22) Filed: Mar. 1, 2018

(65) Prior Publication Data

US 2019/0269297 A1 Sep. 5, 2019

(51) Int. Cl.

| | |
|---|---|
| ***A47B 81/00*** | (2006.01) |
| ***A47L 15/50*** | (2006.01) |
| ***A47B 57/26*** | (2006.01) |

(52) U.S. Cl.

CPC ..... *A47L 15/504* (2013.01); *A47B 57/26* (2013.01); *A47L 15/507* (2013.01)

(58) Field of Classification Search

CPC ..... A47L 15/504; A47L 15/507; A47B 57/26
See application file for complete search history.

(56) References Cited

U.S. PATENT DOCUMENTS

| | | | | |
|---|---|---|---|---|
| 490,022 A | | 1/1893 | Horn | |
| 3,736,037 A | * | 5/1973 | Doepke | A47B 51/00 312/351 |
| 3,822,085 A | * | 7/1974 | Clark | A47L 15/504 312/351 |
| 5,474,378 A | * | 12/1995 | Smith | A47L 15/504 312/334.4 |
| 5,595,200 A | * | 1/1997 | Favaro | A47L 15/504 134/201 |
| 5,657,878 A | * | 8/1997 | Austin | A47L 15/504 211/208 |
| 5,860,716 A | | 1/1999 | Good et al. | |
| 7,775,378 B2 | | 8/2010 | Tynes et al. | |
| 8,813,766 B2 | | 8/2014 | Bhajak et al. | |
| 9,579,009 B2 | | 2/2017 | Bhajak et al. | |
| 9,596,975 B2 | | 3/2017 | Bhajak et al. | |
| 9,681,792 B2 | | 6/2017 | Bhajak et al. | |
| 2003/0075517 A1 | * | 4/2003 | Jahrling | A47L 15/504 211/41.8 |
| 2006/0237042 A1 | | 10/2006 | Weaver et al. | |

(Continued)

*Primary Examiner* — Matthew W Ing
(74) *Attorney, Agent, or Firm* — Nyemaster Goode, P.C.

(57) ABSTRACT

A dishwasher has an interior with a tub and a dish rack slidably attached to the tub. The dish rack has vertically-oriented side rail and a height adjustment system. The adjustment system includes height adjustment mechanisms alongside the walls of the dish rack for vertically shifting the dish rack between lowered and raised positions relative to the tub. Each of the adjustment mechanisms includes an adjuster arm fixed vertically relative to the tub, with a locking boss at the first end, and a locking clip on the adjuster arm having at least one locking tab adapted to couple with the locking boss to prevent the rack from shifting vertically relative to the adjuster arm. The locking clip has a pair of interference ribs engaging a pair of side rails to prevent rotational movement of the rack with respect to the dishwasher.

17 Claims, 6 Drawing Sheets

(56) References Cited

U.S. PATENT DOCUMENTS

| | | | | |
|---|---|---|---|---|
| 2008/0272072 | A1* | 11/2008 | Tynes | A47L 15/504 211/41.8 |
| 2009/0050186 | A1* | 2/2009 | Kim | A47L 15/504 134/165 |
| 2009/0096338 | A1* | 4/2009 | Jahrling | A47L 15/504 312/334.5 |
| 2013/0300269 | A1* | 11/2013 | Garnett | A47L 15/504 312/228.1 |
| 2014/0145573 | A1* | 5/2014 | Cox | A47L 15/507 312/228.1 |
| 2014/0217868 | A1 | 8/2014 | Bhajak et al. | |
| 2016/0331204 | A1 | 11/2016 | Kutto et al. | |
| 2017/0127906 | A1 | 5/2017 | Bhajak et al. | |

* cited by examiner

STABLE HEIGHT ADJUSTER MECHANISM

BACKGROUND OF THE DISCLOSURE

Users are desirous of dishwasher racks that have vertical adjustment to allow for dishwares to be washed of differing heights. The problem with many height adjustment mechanisms today is that they sacrifice stability for adjustment. Disclosed herein is a height adjustment mechanism that combines simplicity of assembly and adjustment, with great stability within the dishwasher.

SUMMARY OF THE PRESENT DISCLOSURE

One aspect of the present disclosure includes a dishwasher having an interior with a tub, a dish rack slidably attached to the tub, the dish rack having a plurality of vertically-oriented side rails, and a height adjustment system including first and second height adjustment mechanisms provided alongside walls of the dish rack for vertically shifting the dish rack between lowered and raised positions relative to the tub. Each of the first and second height adjustment mechanisms includes an adjuster arm fixed vertically relative to the tub, having at least one locking boss at the first end, and a locking clip on the adjuster arm having at least one locking tab adapted to couple with the locking boss to prevent the rack from shifting vertically relative to the adjuster arm. The locking clip has a pair of interference ribs engaging a pair of side rails to prevent rotational movement of the rack with respect to the dishwasher.

Another aspect of the present disclosure includes a dishwasher having an interior defined by a tub having a bottom, rear, top, and side walls, a support rail assembly attached to the tub, a dish rack slidably attached to the support rail assembly, the dish rack including a plurality of vertically-oriented side rails that form a side wall, and a height adjustment system. The height adjustment system includes first and second height adjustment mechanisms provided alongside walls of the dish rack for vertically shifting the dish rack between lowered and raised positions relative to the tub, each of the first and second height adjustment mechanisms including an adjuster arm fixed vertically relative to the tub, the adjuster arm including at least one locking opening, and a clip secured to the rack, the clip including at least one locking tab adapted to couple with the at least one locking boss to prevent the clip from shifting vertically relative to the adjuster arm, and a pair of interference ribs configured to engage a pair of side rails to prevent rotational movement of the rack with respect to the dishwasher.

Yet another aspect of the present disclosure includes a height adjuster for a sliding rack in an appliance having a horizontal base portion having an inside face and an outside face, the base portion configured to fixedly attach to a support rail assembly on the outside face, and operably couple to a sliding rack, the horizontal base portion having a locking boss, a vertically oriented height adjuster portion slidably coupled to the horizontal base portion near a middle portion of the horizontal base portion, and configured to fixedly couple to the sliding rack, a locking clip removably attached to the horizontal base portion including at least one locking tab adapted to operably couple with the locking boss to prevent the sliding rack from shifting vertically relative to the adjuster portion, and a pair of interference ribs configured to engage a pair of side rails to prevent rotational movement of the base portion.

These and other aspects, objects, and features of the present disclosure will be understood and appreciated by those skilled in the art upon studying the following specification, claims, and appended drawings.

DETAILED DESCRIPTION OF EMBODIMENTS

Figure 1:
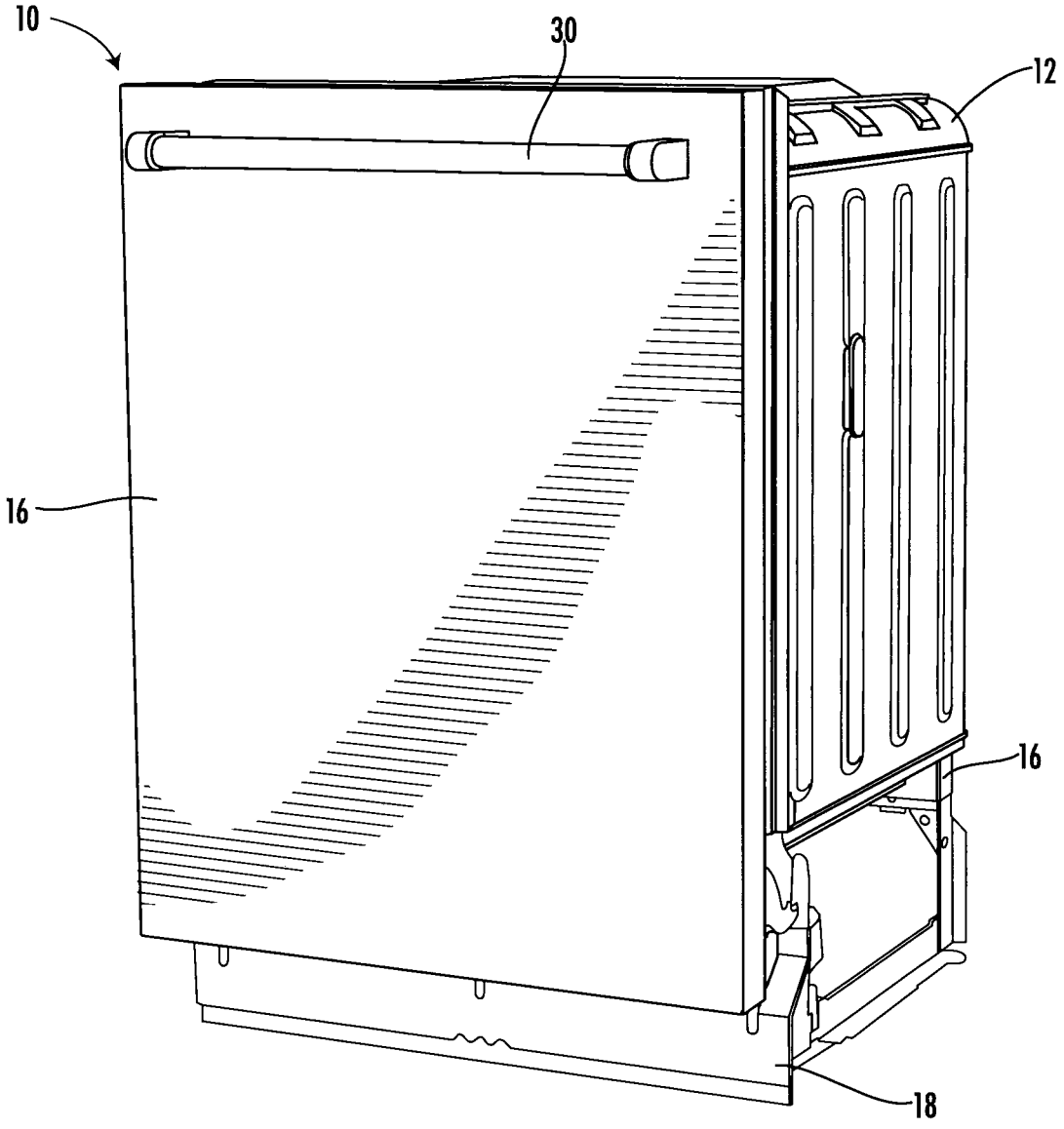
FIG. 1 is an isometric view of a dishwasher of an embodiment.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With initial reference to FIG. 1, a dishwasher constructed in accordance with the present disclosure is generally indicated at 10. As shown, dishwasher 10 includes a tub 12, which may be plastic, metal, or any other material known in the art. The tub 12 may include integral bottom, side, rear and top walls respectively. The inside surface of the tub 12 defines a washing chamber 14 within which soiled dishware and other kitchenware is placed on a lower dish rack 20 and an adjustable upper dish rack 30, which will be detailed more fully below, includes a vertical adjustment assembly 40 for vertically shifting dish rack 30 between a first or lowered position and a second or raised position.

Figure 2:
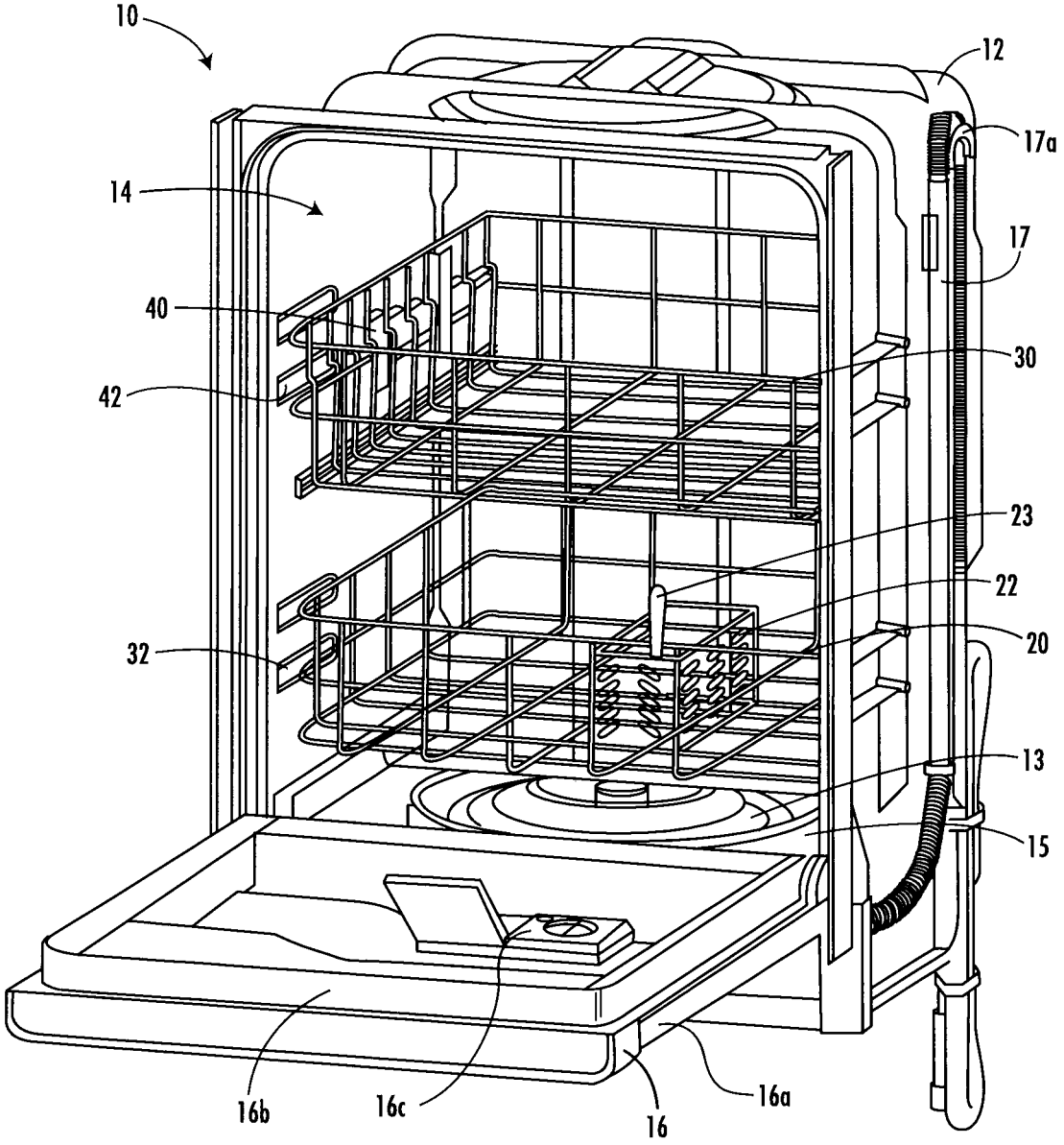
FIG. 2 is an isometric view of a dishwasher of an embodiment with the front door open.
Figure 3:
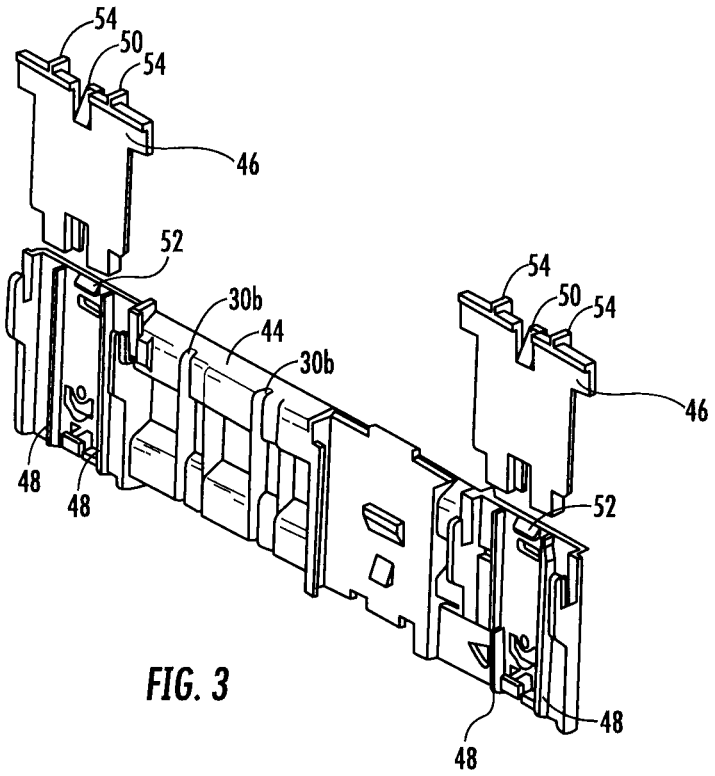
FIG. 3 is an exploded view of the base and locking clips of an embodiment.
Figure 4:
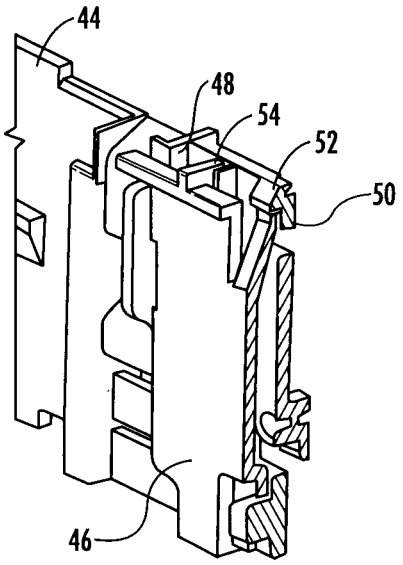
FIG. 4 is a cross-section through the base and locking clip of an embodiment.
Figure 5:
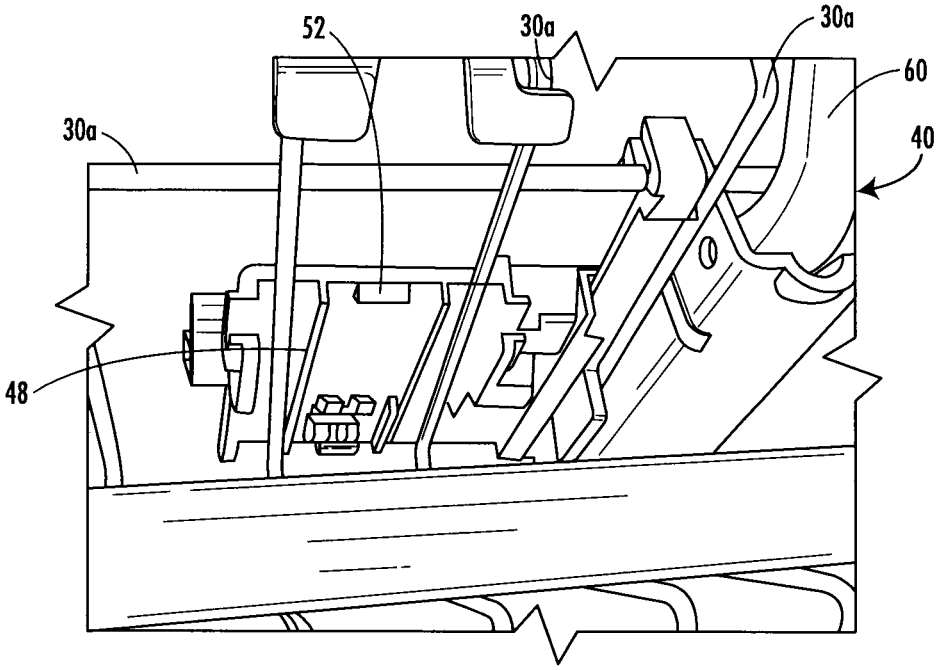
FIG. 5 is a view of the base of an embodiment attached to a dishrack with the locking clip removed.
Figure 6:
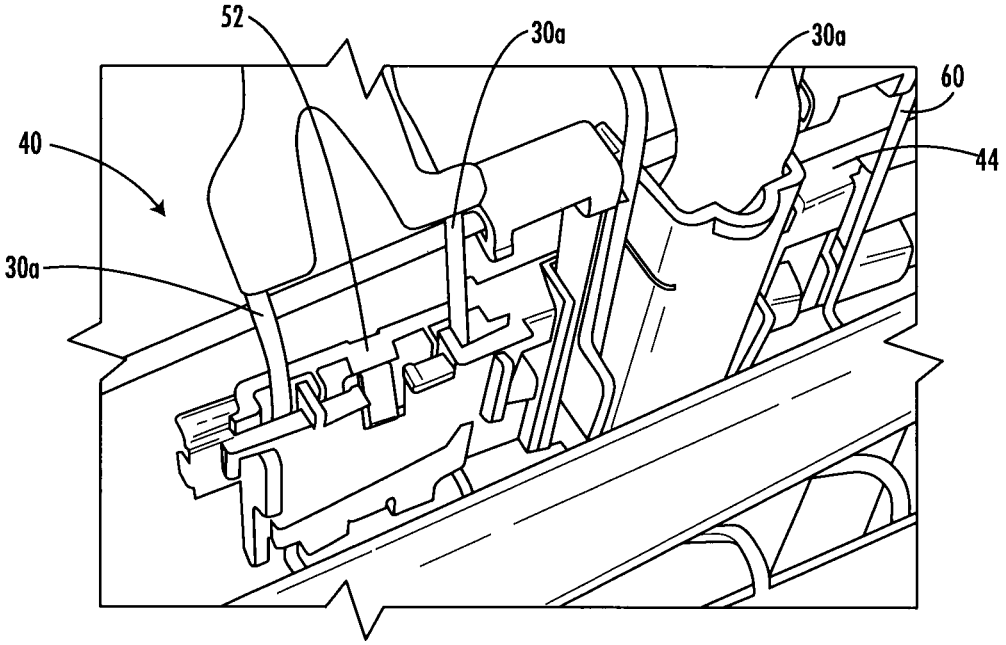
FIG. 6 is a view of the base and locking clip of an embodiment attached to a dishrack.
Figure 7:
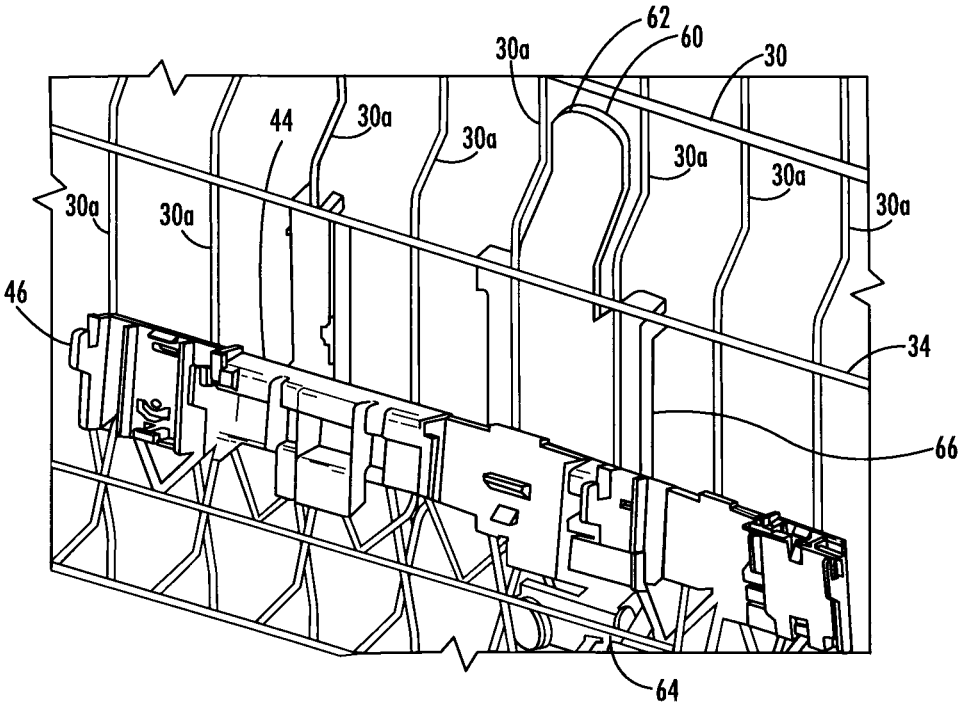
FIG. 7 is an isometric view of a locking clip of an embodiment.
Figure 8:
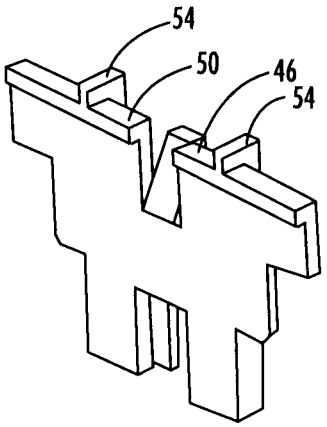
FIG. 8 is an isometric view of an embodiment showing an adjuster arm.
Figure 9:
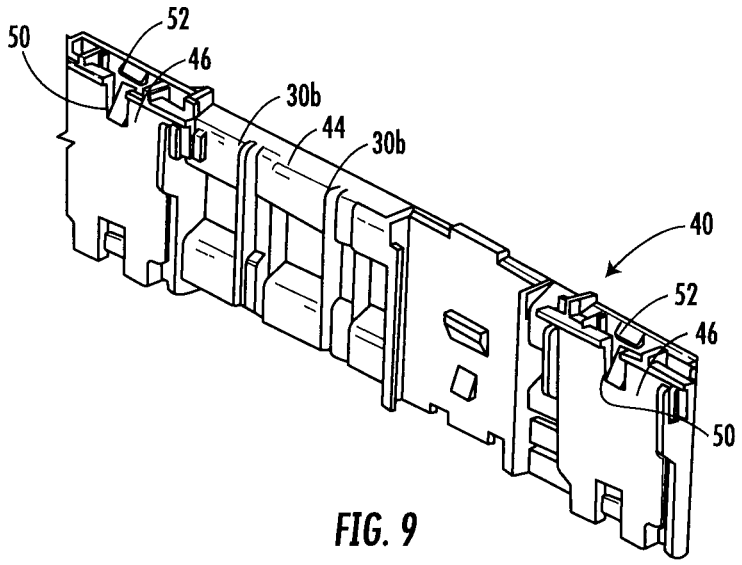
FIG. 9 is an isometric view of an assembled base and locking clip of an embodiment.

As shown in FIG. 2, a utensil basket 22, which contains a utensil 23, is positioned within lower rack utensil basket 22. The tub 12 may also have a door 16 that is pivotally or rotationally attached to a frame 18, the door 16 used to seal washing chamber 14 during a washing operation, keeping wash water and heat within the tub 12. The door 16 may have an exterior panel **16*a* and an interior panel 16*b* preferably provided with a dispensing assembly 16*c*** within which a consumer can place liquid, particulate or gel washing detergent for dispensing at predetermined periods of the washing operation.

The lower dishrack 20 and upper dish rack 30 may each be separately horizontally moveable between a first position where dish racks 20, 30 are entirely within the confines of washing chamber 14 and a second position, wherein dish racks 20, 30 extend at least partially outwardly from washing chamber 14. The tub 12 may have extendible support rail assemblies 32, 42. The support rail assemblies may have an inner support and an outer support that are slidably attached to one another. The inner support and outer support may be coupled through ball bearings which allow the two supports to smoothly and easily slide with respect to one another. In another embodiment, there may be a third intermediate support rail between the inner and outer support, although this is not necessary. When in the second position, lower dish rack 20 may rest on the inner panel 16*b* of the door 16. The interior panel may have guides (not shown) molded or stamped into it allowing wheels of the lower rack 20 to roll within the guides.

Disposed within tub 12 and, more specifically, mounted within a central opening formed in the bottom wall of tub 12, is a pump and filter assembly 13. Extending about a substantial portion of pump and filter assembly 13, at a position raised above the bottom wall of the tub 12, is a heating element 15. In a manner known in the art, heating element 15 preferably takes the form of a sheathed, electric resistance-type heating element. In general, pump and filter assembly 13 is adapted to direct washing fluid to a lower wash arm and at least one upper wash arm (not shown). Dishwasher 10 may have associated therewith a drain hose 17 including at least one corrugated or otherwise curved portion 17*a* that extends about an arcuate hanger provided on an outside surface of the tub 12. Drain hose 17 may be secured to the tub 12 by a plurality of clips or anything else known in the art. In this manner, an upper loop is maintained in drain hose 17 to assure proper drainage in a manner known in the art. As the exact structure and operation of pump and filter assembly 13 of dishwasher 10 is not part of the present disclosure, it will not be discussed further herein. Instead, the present disclosure is directed to particulars of height adjustment mechanism 40. However, at this point it should be noted that the disclosure can be employed in connection with adjusting the height of dish racks in various types of dishwashers, including the more conventional type shown in FIG. 1 and drawer dishwashers. Of course, with drawer dishwashers, the dish rack would not be extendible, but still the dish rack could be vertically adjustable.

Reference will now be made to FIGS. 3-9 in describing the particular details of height adjustment mechanism 40 and its connection to rack 30. The rack 30 may be formed of interconnected wires so as to define a plurality of generally horizontal or bottom rails which extend up and define generally vertical, opposing side rails 30*a*. As represented in these figures, bottom rails have portions thereof which define multiple levels for rack 30 and may be formed with various raised rail portions to more readily support various kitchenware items in a manner known in the art. In general, the particular construction and design of rack 30 can greatly vary in accordance with the disclosure and is known in the art.

The side rails together form a side wall that defines an outer perimeter of the rack 30. The side rails 30*a* are generally parallel and are circular in cross-section. The side rails 30*a* have a front facing portion that faces out of the tub, and a rear facing portion that faces back into the tub. The height of the side rails 30*a* are generally high enough to hold larger dishwares in place while they are sprayed with the wash liquor at high pressure. This height also allows for the adjustment of the dish rack 30 as the height adjustment mechanism 40 connects to the side rails 30*a* as will be described in more detail below.

The adjuster mechanism 40 may have an adjuster arm 44 that is fixed to the sliding mechanism 42. The adjuster arm is fixed relative to the sliding mechanism, which means that as the sliding mechanism slides in and out of the tub, the adjuster arm 44 moves in and out of the tub along with the sliding mechanism 42. The adjuster arm 44 may not move up and down. The adjuster arm may have channels 30*b* that allow the side rails 30*a* to fit within the channels 30*b*. In this way, the adjuster arm fits over but allows vertical movement of the dish rack 30 with respect to the adjuster arm 44. The adjuster arm 44 may also have a locking boss 52.

The adjuster arm may have a locking clip 46 that slidably attaches on either end of the adjuster arm 44. The locking clip 46 may slide downwardly on an end of the base 44. The locking clip may have a locking tab 50 that operably interfaces with the locking boss 52. That is to say, that the design of the locking tab 50 and the locking boss 52 is such that it allows for the locking tab 50 to slide over the locking boss 52 upon installation, but does not allow slidable movement once in place. A user must pull the tab out from the interface if removal is desired.

The locking clip 46 may have interference ribs 54 that correspond to vertical rails 30*a*. When the locking clip is slidable placed and locked onto the adjuster arm base 44, the interference ribs 54 touch opposite sides of adjacent vertical rails 30*a*. That is to say, that one of the interference ribs 54 on the locking clip 46 touches a forward portion of a side rail 30*a*, while the other interference rib 54 touches a rearward portion of another side rail 30*a*. The adjuster arm base 44 may also have interference ribs 48 that touch on the opposite sides of the same adjacent vertical rails 30*a* that the interference ribs 54 on the locking clip touches. In this way, adjacent vertical rails 30*a* are captured between a corresponding set of interference ribs 48 and 54 on the locking clip 46 and the adjuster arm 44. This capture of the vertical rails 30*a* gives much more stability and strength between the adjuster mechanism 40 and the dish rack 30.

Height adjustment mechanism 40 of the disclosure is shown to include an adjuster arm having a main body portion 44 including, at spaced fore-to-aft locations, a plurality of channel defining members 30*b*. Channel defining members 30*b* slidably receive respective vertical side rails 30*a*. In this manner, rack 30 is guided for vertical movement relative to the adjustment mechanism 40.

In addition to the above structure, each adjustment mechanism 40 also includes a locking lever 60 having an upper portion 62, a lower portion 64 and an intermediate or central portion 66. Locking lever 60 is pivotally attached to and mounted for concurrent movement with rack 30. In other words, the locking lever 60 is stationary with respect to the rack 30, but allows for selective movement between the lever 60 and the main body portion 44.

In the embodiment shown, locking lever 60 is directly pivotally attached to an intermediate peripheral rail 34. This locking lever 60 may be similar to an embodiment shown in U.S. Patent Application Publication No. 2016/0331204, which is hereby incorporated by reference. The locking lever 60 may be operably attached to the adjustment mechanism 40 in such a way that when the lever is in its biased or normal position, the rack is not vertically adjustable. A user may rotate the upper portion 62 of the lever 60 toward the middle of the rack 30, which allows relative movement between the lever 60 and the base portion 44. Because the lever 60 does not allow relative vertical movement between the lever and the rack 30, as the lever moves with respect to the base portion 44, so does the rack 30. Locking lever 60 is preferably biased such that the lower portion 64 is forced laterally outwardly.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A dishwasher comprising:

an interior defined by a tub having a bottom, rear, top, and side walls;

a dish rack slidably attached to the tub, the dish rack including a plurality of vertically-oriented side rails; and a height adjustment system including first and second height adjustment mechanisms provided alongside walls of the dish rack for vertically shifting the dish rack between lowered and raised positions relative to the tub, each of the first and second height adjustment mechanisms including:

an adjuster arm having a first end, the adjuster arm fixed vertically relative to the tub, the adjuster arm including at least one locking boss at the first end and a pair of interference ribs configured to engage opposite sides of the pair of side rails to prevent rotational movement of the rack with respect to the dishwasher; and a locking clip removably coupled to the adjuster arm at the first end, the locking clip including at least one locking tab adapted to couple with the at least one locking boss to prevent the rack from shifting vertically relative to the adjuster arm, and a pair of interference ribs configured to engage a pair of side rails to prevent rotational movement of the rack with respect to the dishwasher.

2. The dishwasher of claim 1, wherein the pair of interference ribs engage a pair of adjacently located side rails.

3. The dishwasher of claim 2, wherein the pair of interference ribs engage the adjacently located side rails on opposite sides of the side rails.

4. The dishwasher of claim 1, further comprising a locking lever mounted for pivotal movement relative to the rack, the locking lever including at least one wing member configured to engage the at least one locking tab to release the at least one locking tab from the at least one locking tab to permit vertical shifting of the rack upon pivoting of the locking lever relative to the rack.

5. The dishwasher of claim 1, further comprising a support rail assembly with at least two support rails.

6. The dishwasher of claim 5, wherein the dish rack is fixedly attached to a first of the at least two support rails, and a second of the at least two support rails is fixedly attached to the tub.

7. The dishwasher of claim 6, wherein the support rail assembly further comprises ball bearings between the at least two support rails for providing sliding relative motion between the at least two support rails.

8. A dishwasher comprising:

an interior defined by a tub having a bottom, rear, top, and side walls;

a support rail assembly attached to the tub;

a dish rack slidably attached to the support rail assembly, the dish rack including a plurality of vertically-oriented side rails that form a side wall; and a height adjustment system including first and second height adjustment mechanisms provided alongside walls of the dish rack for vertically shifting the dish rack between lowered and raised positions relative to the tub, each of the first and second height adjustment mechanisms including:

an adjuster arm fixed vertically relative to the tub, the adjuster arm including at least one locking opening and a pair of interference ribs configured to engage opposite sides of the pair of side rails to prevent rotational movement of the rack with respect to the dishwasher; and a clip secured to the rack, the clip including at least one locking tab adapted to couple with the at least one locking boss to prevent the clip from shifting vertically relative to the adjuster arm, and a pair of interference ribs configured to engage a pair of side rails to prevent rotational movement of the rack with respect to the dishwasher.

9. The dishwasher of claim 8, wherein the pair of interference ribs engage a pair of adjacently located side rails.

10. The dishwasher of claim 9, wherein the pair of interference ribs engage the adjacently located side rails on opposite sides of the side rails.

11. The dishwasher of claim 8, further comprising a locking lever mounted for pivotal movement relative to the rack, the locking lever including at least one wing member configured to engage the at least one locking tab to release the at least one locking tab from the at least one locking opening to permit vertical shifting of the rack upon pivoting of the locking lever relative to the rack.

12. The dishwasher of claim 8, further comprising a support rail assembly with at least two support rails.

13. The dishwasher of claim 12, wherein the dish rack is fixedly attached to a first of the at least two support rails, and a second of the at least two support rails is fixedly attached to the tub.

14. The dishwasher of claim 13, wherein the support rail assembly further comprises ball bearings between the at least two support rails for providing sliding relative motion between the at least two support rails.

15. A height adjuster for a sliding rack in an appliance comprising:

a horizontal base portion having an inside face and an outside face, the base portion configured to fixedly attach to a support rail assembly on the outside face, and operably couple to a sliding rack, the horizontal base portion having a locking boss;

a vertically oriented height adjuster portion slidably coupled to the horizontal base portion near a middle portion of the horizontal base portion, and configured to fixedly couple to the sliding rack, the adjuster portion including a pair of interference ribs configured to engage opposite sides of the pair of side rails to prevent rotational movement of the rack with respect to the dishwasher;

a locking clip removably attached to the horizontal base portion including at least one locking tab adapted to operably couple with the locking boss to prevent the sliding rack from shifting vertically relative to the adjuster portion, and a pair of interference ribs configured to engage a pair of side rails to prevent rotational movement of the base portion.

16. The height adjuster of claim 15, wherein the appliance is a dishwasher.

17. The height adjuster of claim 16, further comprising a locking lever mounted for pivotal movement relative to the rack to permit vertical shifting of the rack upon pivoting of the locking lever relative to the rack.

* * * * *